United States Patent [19]

Odham

[11] 4,003,224

[45] Jan. 18, 1977

[54] WARP KNIT ELASTIC FABRIC HAVING RAVEL RESISTANT FEATURES

[75] Inventor: Carl J. Odham, Asheboro, N.C.

[73] Assignee: Stedman Corporation, Asheboro, N.C.

[22] Filed: Apr. 12, 1976

[21] Appl. No.: 676,373

[52] U.S. Cl. ..... 66/193

[51] Int. Cl.[2] ..... D04B 7/12; D04B 9/12; D04B 11/08; D04B 23/08

[58] Field of Search ..... 66/190, 192, 195, 193, 66/172, 19, 177

[56] References Cited

UNITED STATES PATENTS

| | | | |
|---|---|---|---|
| 3,258,941 | 7/1966 | Formenti | 66/193 |
| 3,314,251 | 4/1967 | Bunger | 66/193 |
| 3,673,820 | 7/1972 | Sarmiento | 66/177 |

FOREIGN PATENTS OR APPLICATIONS

| | | | |
|---|---|---|---|
| 469,702 | 12/1928 | Germany | 61/193 |
| 1,204,354 | 11/1965 | Germany | 66/19 |

*Primary Examiner*—Ronald Feldbaum
*Attorney, Agent, or Firm*—Pennie & Edmonds

[57] ABSTRACT

An elastic warp knit fabric with ravel resistant features having a plurality of base yarns where each base yarn is knitted in successive courses to form a plurality of closed loops which extend in a warp direction and which form a plurality of individual wales. At least one of the wales is a locking wale forming one lateral edge of the fabric and another of the wales is an intermediate wale. An elastic yarn is laid into at least one of the intermediate wales and one of the locking wales. A first filler yarn extends in a weft direction in each course and is contained within the closed loops of adjacent wales to connect the wales together. A locking yarn is knitted in a locking wale to form an open loop in alternate courses where a portion of the locking yarn extends in a weft direction along with the filler yarn whereby the locking yarn prevents unraveling of the lateral edge of the fabric.

6 Claims, 2 Drawing Figures

WARP KNIT ELASTIC FABRIC HAVING RAVEL RESISTANT FEATURES

BACKGROUND OF THE INVENTION

Warp knit elastic fabrics are commonly used as belting for undergarments and the like. The fabric in the form of a strip is sewn along a bottom edge to the waist portion of the undergarment and sewn at its ends to form a butt type joint. If through production errors the joint is uneven, a portion of the end of the fabric will extend above the joint. A problem with conventional warp knit elastic fabrics is a tendency of this upstanding end portion to unravel along a lateral edge which forms the upper edge of the waistband.

One form of prior art elastic warp knit fabric which has attempted to overcome this unraveling tendency has utilized a plurality of base yarns each knitted in closed loops in successive courses which are joined by filler yarns extending in a weft direction and which are contained in the closed loops. A so-called locking yarn is knitted into each course of the two warps adjacent a lateral edge of the fabric such that an open loop is formed in each course but in alternate wales. It has been found however that such fabric may still unravel under certain conditions such as described previously where the fabric is utilized as a belting and the butt joint between the ends of the fabric is uneven.

It is therefore an object of my invention to provide for an elastic warp knit fabric which may be utilized as belting for undergarments and the like which will have a structure to resist unraveling even in the event that in the manufacture of the garment the ends of the fabric forming the belting are misjoined with an exposed portion extending over one lateral edge.

Broadly my invention comprises having an elastic warp knit fabric made up of a plurality of base yarns with each base yarn knitted in successive courses to form a plurality of successive closed loops which extend in a warp direction and which form a plurality of individual wales. At least one of the wales comprises a locking wale and at least one of the wales an intermediate wale. An elastic yarn is laid into at least one intermediate wale and at least one locking wale. A first filler yarn extends in a weft direction in each course and is contained within the closed loops of adjacent wales to connect the wales together in a weft direction. A locking yarn is knitted into a locking wale in open loops in alternate courses of the wale and has a portion extending in a weft direction along with the filler yarn such that it is contained in the closed loops of at least one intermediate wale. Preferably the locking wale forms one lateral edge of the fabric and includes also an adjacent locking wale followed by a plurality of intermediate wales. The locking yarn has a weft extending portion which extends preferably over a plurality of intermediate wales. A second filler yarn may be included and preferably extends parallel to the initial filler yarn.

DESCRIPTION OF THE PREFERRED EMBODIMENTS

Figure 1:
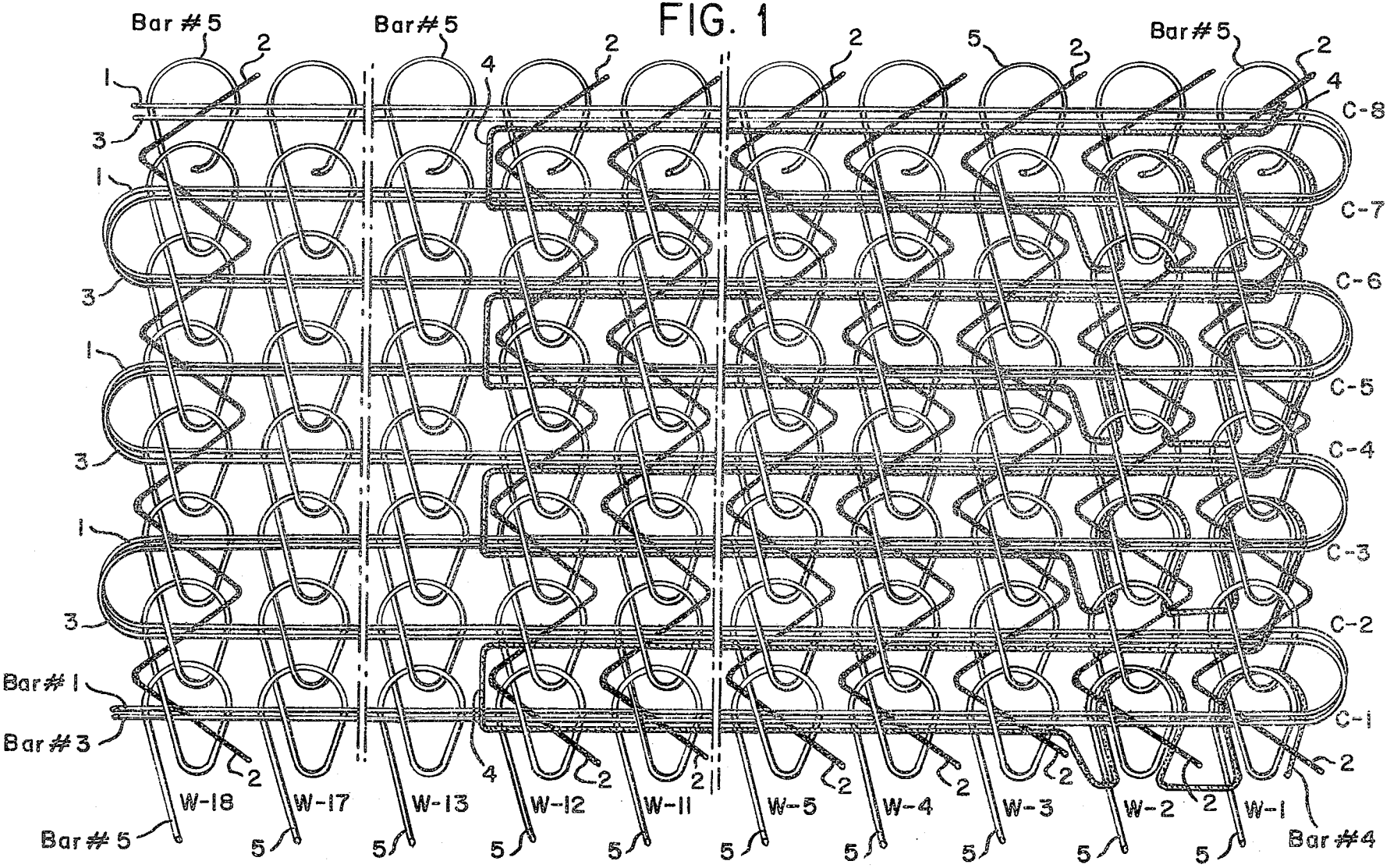
FIG. 1 is a schematic sketch illustrating the preferred stitch configuration of a warp knit elastic fabric made according to the invention.
Figure 2:
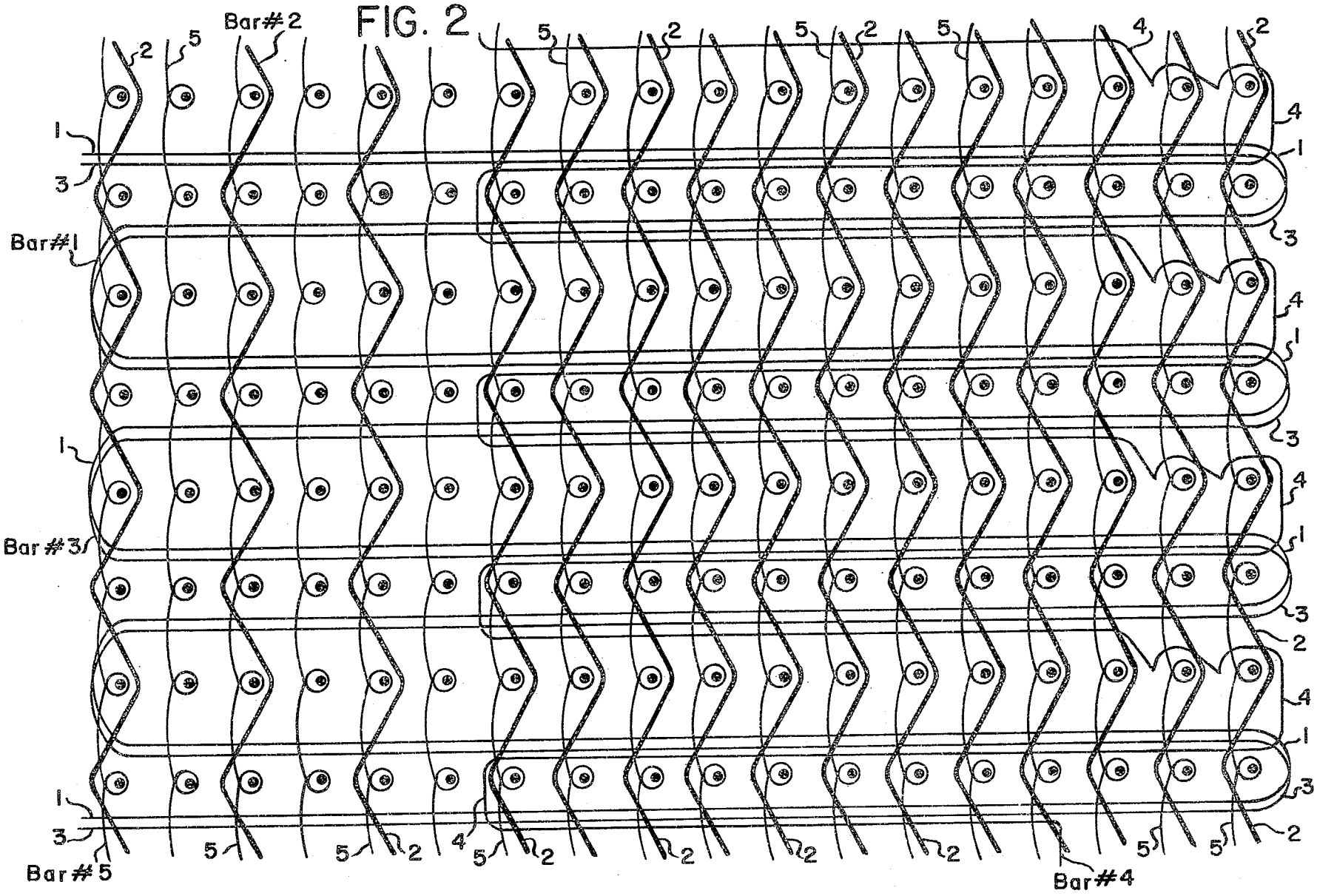
FIG. 2 is a stitch construction diagram of the fabric of FIG. 1 illustrating guide bar movement used in producing the fabric.

Referring to FIG. 1 there is illustrated an elastic fabric constructed according to the invention which may be produced on a flat bed Raschel type knitting machine having a single needle bar and five guide bars. As shown the fabric comprises a plurality of wales W1–W18 and in which, for clarity reasons, some of the wales have been omitted. Each wale is formed by a base yarn 5 controlled by a guide bar 5 # (not shown) which is knitted in successive courses C1–C8 to form a plurality of successive closed loops in turn forming a wale extending in a warp direction. The yarn is non-elastic and may comprise a synthetic or natural material. Lapping movement of the yarn 5 about the knitting needles of the machine as imparted by the guide bar 5 # is illustrated in FIG. 2.

An elastic yarn 2 controlled by guide bar 2 # (not shown) is laid into each of the wales formed by the base yarn and may comprise a base rubber yarn or covered rubber yarn, the only requirement being that the yarn expand and contract positively.

Filler yarns 1 and 3 are laid into the fabric by guide bars 1 # and 3 # (not shown) and extend across the width of the fabric and serve to hold the adjacent wales together. As shown, the yarns 1 and 3 are contained within the closed loops formed by the base yarn 5. The filler yarns are laid in one direction in one course and then in opposite direction in the next adjacent course.

A locking yarn 4 controlled by a guide bar 4 # (not shown) is knitted in open loops in wale W1, which forms one lateral edge of the fabric, and then into wale W2 after which it is laid across intermediate wales W3–W12 along with the filler yarns 1 and 3, and then laid across wales W12–W1 along with the filler yarns in course 2. The yarn 4 is then knitted again in open loops in course 3 of wales W1 and W2 with the pattern then repeated. The locking yarn provides a ravel resistant feature to the lateral edge of the fabric formed by wale W1 to prevent unraveling in the warp direction.

The motion of the yarns 1–4 imparted by guide bars 1 #–4 # is shown in FIG. 2. The invention contemplates having at least the end warp W1 including the locking yarn knitted in alternate courses and preferably in the next adjacent warp W2 such that both wales W1 and W2 can be characterized as locking wales. The remainder of the wales can be characterized as intermediate wales. It is obvious that the locking yarn could be knitted into other of the wales including the wale W18 comprising the other lateral edge of the fabric if desired. Further the portion of the yarn 4 extending over the intermediate wales is illustrated as extending between wales W3 and W12. Again the invention contemplates having the portion of the locking yarn extend over a varying number of intermediate wales, and as shown with respect to wales W13–W18, it is not necessary to have the weft extending portion of the yarn 4 extend over the complete width of the fabric.

In the description of the numbering of the various guide bars and reference to the yarns controlled by the guide bars, the guide bars are numbered from the back to the front, that is to say, guide bar 1 is the closest to the needle bed whereas guide bar 5 is the furthest away from the needle bed.

Preferably the needle arrangement of a machine for producing the fabric according to the invention is such that the needles knitting the locking wales W1 and W2 are latch type needles with the remainder of the needles of the machine being spring or beard type needles.

I claim:

1. An elastic warp knit fabric comprising a plurality of base yarns each knitted in successive courses to form a plurality of successive closed loops extending in a warp direction and to form a plurality of individual wales including at least one locking wale and at least one intermediate wale, an elastic yarn laid into at least one intermediate wale and at least one locking wale, a first filler yarn extending in a weft direction in each course and contained within the closed loops of adjacent wales to connect adjacent wales together, and a locking yarn knitted to form an open loop in alternate courses in each said locking wale and laid in a weft extending direction in the remaining courses of each said locking wale and having a portion extending in a weft direction along with said first filler yarn in each course and contained within the closed loops of at least one intermediate wale.

2. An elastic warp knit fabric according to claim 1 wherein a locking wale forms one lateral edge of said fabric.

3. An elastic warp knit fabric according to claim 2 having two locking wales adjacent each other and a plurality of intermediate wales with said locking yarn contained within the closed loops of a plurality of intermediate wales in a single course.

4. An elastic warp knit fabric according to claim 3 having in addition a second filler yarn laid parallel in each course with said first filler yarn and wherein said first and second filler yarns are contained within the closed loops of a greater number of intermediate wales than said locking yarn.

5. An elastic warp knit fabric having ravel resistant features comprising a plurality of base yarns each knitted in successive courses to form a plurality of successive closed loops with the loops of a single yarn forming a warp extending wale, an elastic yarn laid into said wale, a filler yarn extending in a weft direction in each said course and contained within the closed loops of the base yarn to connect adjacent wales together, and a locking yarn knitted in alternate courses to form open loops in two wales adjacent one lateral edge of said fabric and extending in a weft direction along with said filler yarn in the remaining courses of said two wales with a portion of the locking yarn being contained within the closed loops of all courses of a plurality of other wales adjacent the said two wales.

6. A method of making an elastic warp knit fabric comprising the steps of knitting each of a plurality of base yarns in successive courses to form a plurality of closed loops extending in a warp direction to form a single wale, laying an elastic yarn into some of said wales including an end wale forming a lateral edge of said fabric, laying a filler yarn across the width of the fabric in each course while said base yarn is being knitted whereby said closed loops contain the base yarn, and knitting a locking yarn into the end wale in alternate courses to form a plurality of open loops while said base yarns are being knitted and laying a portion of said locking yarn across a number of other wales along with the filler yarn in the alternate courses in which the locking yarn is knitted and laying the locking yarn along with the filler yarn across the end wale and said other wales in alternate courses in which the locking yarn is not knitted.

* * * * *